US009012749B2

(12) United States Patent
Ikeda

(10) Patent No.: US 9,012,749 B2
(45) Date of Patent: Apr. 21, 2015

(54) MUSIC BOX

(71) Applicant: Akihiro Ikeda, Obu (JP)

(72) Inventor: Akihiro Ikeda, Obu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/153,501

(22) Filed: Jan. 13, 2014

(65) Prior Publication Data

US 2014/0202302 A1 Jul. 24, 2014

(30) Foreign Application Priority Data

Jan. 22, 2013 (JP) ..... 2013-009366
Jan. 22, 2013 (JP) ..... 2013-009367

(51) Int. Cl.
*G10F 1/06* (2006.01)
*G10F 5/06* (2006.01)
*G04B 23/00* (2006.01)

(52) U.S. Cl.
CPC ..... *G10F 1/06* (2013.01); *G04B 23/005* (2013.01); *G04B 23/00* (2013.01); *G10F 5/06* (2013.01)

(58) Field of Classification Search
CPC ..... G10F 1/06; G10F 5/06; G04B 23/00; G04B 23/005
USPC ..... 84/97, 98, 94.1, 95.1
See application file for complete search history.

(56) References Cited

U.S. PATENT DOCUMENTS 593,762 A * 11/1897 Brachhausen ..... 84/98
2,557,061 A * 6/1951 Goldman ..... 84/94.1
2,961,911 A * 11/1960 Duncan ..... 84/97
3,148,576 A * 9/1964 Kunz ..... 84/95.1
3,225,640 A * 12/1965 Kunz ..... 84/95.1
3,342,499 A * 9/1967 Niimi et al. ..... 369/186
4,466,328 A * 8/1984 Kitamura ..... 84/98
4,676,135 A * 6/1987 Kitazawa et al. ..... 84/94.1
4,890,528 A * 1/1990 Kamijima ..... 84/95.2
5,498,833 A * 3/1996 Huang ..... 84/94.1
5,955,687 A * 9/1999 Miyagi et al. ..... 84/97
5,973,240 A * 10/1999 Isaka ..... 84/97
6,013,867 A * 1/2000 Isaka ..... 84/97
6,300,548 B1 * 10/2001 Zhu et al. ..... 84/94.1
7,250,565 B2 * 7/2007 Hermanson et al. ..... 84/94.1

(Continued)

FOREIGN PATENT DOCUMENTS

JP 11272267 A * 10/1999 ..... G10F 1/06
JP 11272268 A * 10/1999 ..... G10F 1/06

(Continued)

*Primary Examiner* — David Warren
*Assistant Examiner* — Christina Schreiber
(74) *Attorney, Agent, or Firm* — Scully, Scott, Murphy & Presser, P.C.

(57) ABSTRACT

A music box includes a plurality of star wheels, a plurality of vibration valves, a plurality of anchoring members, a plurality of electromagnets, and a control unit. The control unit is configured to control one or more of the plurality of the electromagnets to be a first state by supplying a first electricity and control each of the plurality of electromagnets to be a second state by supplying a second electricity. Each of the plurality of anchoring members is configured to engage with one of the plurality of protruding parts in the second state. The one or more of the plurality of anchoring members is configured to rotate about a second axis extending parallel to a first axis in the first state, and the one or more of the plurality of anchoring members is positioned remote from the electromagnet with a gap therebetween in the first state.

20 Claims, 7 Drawing Sheets

(56) References Cited

U.S. PATENT DOCUMENTS

| | | | | |
|---|---|---|---|---|
| 7,544,870 | B2 * | 6/2009 | White | 84/94.1 |
| 2004/0031370 | A1 * | 2/2004 | Ueno et al. | 84/94.1 |
| 2004/0065184 | A1 * | 4/2004 | Isaka et al. | 84/94.1 |
| 2004/0123718 | A1 * | 7/2004 | Muramatsu et al. | 84/94.1 |
| 2006/0169122 | A1 * | 8/2006 | Meng-Suen | 84/94.1 |
| 2008/0184863 | A1 * | 8/2008 | White | 84/95.1 |
| 2012/0192697 | A1 * | 8/2012 | Favre | 84/95.1 |
| 2014/0202302 | A1 * | 7/2014 | Ikeda | 84/95.1 |
| 2014/0202303 | A1 * | 7/2014 | Ikeda | 84/98 |
| 2014/0202304 | A1 * | 7/2014 | Ikeda et al. | 84/98 |

FOREIGN PATENT DOCUMENTS

| | | | | |
|---|---|---|---|---|
| JP | 2002-073013 | A | | 3/2002 |
| JP | 2009116323 | A | * | 5/2009 |
| JP | 2011-128348 | A | | 6/2011 |
| JP | 2011128348 | A | * | 6/2011 |

* cited by examiner

MUSIC BOX

CROSS REFERENCE TO RELATED APPLICATION

This application claims priority from Japanese Patent Application No. 2013009366 filed Jan. 22, 2013 and Japanese Patent Application No. 2013009367 filed Jan. 22, 2013. The entire contents of these priority applications are incorporated herein by reference.

TECHNICAL FIELD

The present disclosure relates to a music box, and particularly to a music box that suppresses the production of unwanted noise.

BACKGROUND

Music boxes that play melodies are well known in the art. One such music box includes: a plurality of star wheels rotatably supported on a shaft and having a plurality of protruding parts protruding radially outward; a vibration plate disposed along the shaft and having a plurality of vibration valves corresponding to the plurality of star wheels; and a solenoid for each star wheel.

The solenoid is driven to control the rotation of the corresponding star wheel. The music box produces a melody by selectively contacting the vibration valves with the protruding parts on the star wheels. By controlling the rotation of the star wheels with solenoids, the protruding parts can be selectively made to contact and pluck the corresponding vibration valves at a prescribed timing. Accordingly, the conventional music box device can play arbitrary musical pieces, without having to replace a rotating member, such as a cylinder or disc.

SUMMARY

However, since the conventional music box device drives solenoids in order to control the rotation of the star wheels, suction of the solenoid and the like can produce sounds of impact, introducing unwanted noise into the musical piece produced by the music box. The adverse effects of this noise are non-negligible for music boxes, whose principal function is to play sounds. The inventors of the present disclosure came across this problem while conducting thorough ongoing research aimed at improving music boxes.

In view of the foregoing, it is an object of the present disclosure to provide a music box that minimizes the generation of unwanted noise.

In order to attain the above and other objects, the present disclosure provides a music box. A music box includes a plurality of star wheels, a plurality of vibration valves, a plurality of anchoring members, a plurality of electromagnets, and a control unit. The plurality of star wheels is configured to rotate about a first axis. Each of the plurality of star wheels includes a plurality of protruding parts protruding outward in a radial direction of each of the plurality of star wheels. The plurality of vibration valves corresponds to the plurality of star wheels. The plurality of vibration valves is arrayed along a first direction extending parallel to the first axis. The plurality of anchoring members corresponds to the plurality of star wheels. Each of the anchoring members is configured to engage corresponding one of the plurality of protruding parts. The plurality of electromagnets corresponds to the plurality of anchoring members. The control unit is configured to control one or more of the plurality of the electromagnets to be a first state by supplying a first electricity and control each of the plurality of electromagnets to be a second state by supplying a second electricity. The second electricity is lower than the first electricity. Each of the plurality of anchoring members is configured to engage with one of the plurality of protruding parts in the second state. The one or more of the plurality of anchoring members is configured to rotate about a second axis extending parallel to the first axis in the first state, and the one or more of the plurality of anchoring members is positioned remote from the electromagnet with a gap therebetween in the first state.

According to another aspect, the present disclosure provides a music box. The music box includes a plurality of star wheels, a plurality of vibration valves, a plurality of anchoring members, a plurality of electromagnets, and a control unit. The plurality of star wheels is configured to rotate about a first axis. Each of the plurality of star wheels comprises a plurality of protruding parts protruding outward in a radial direction of each of the plurality of star wheels. The plurality of vibration valves corresponds to the plurality of star wheels. The plurality of vibration valves is arrayed along a first direction extending parallel to the first axis. The plurality of anchoring members corresponds to the plurality of star wheels. Each of the anchoring members is configured to engage corresponding one of the plurality of protruding parts. The plurality of electromagnets corresponds to the plurality of anchoring members. The control unit is configured to control one or more of the plurality of the electromagnets to be a first state by supplying an electricity and control each of the plurality of electromagnets to be a second state in which a supply of the electricity is stopped. Each of the plurality of anchoring members is configured to engage with one of the plurality of protruding parts in the second state. The one or more of the plurality of anchoring members is configured to rotate about a second axis extending parallel to the first axis in the first state, and the one or more of the plurality of anchoring members is positioned remote from the electromagnet with a gap therebetween in the first state.

According to still another aspect, the present disclosure provides a music box. The music box includes a plurality of star wheels, a plurality of vibration valves, a plurality of anchoring members, a plurality of electromagnets, and a control unit. The plurality of star wheels is configured to rotate about a first axis. Each of the plurality of star wheels includes a plurality of protruding parts protruding outward in a radial direction of each of the plurality of star wheels. The plurality of vibration valves corresponds to the plurality of star wheels. The plurality of vibration valves is arrayed along a first direction extending parallel to the first axis. The plurality of anchoring members corresponds to the plurality of star wheels. Each of the anchoring members is configured to engage corresponding one of the plurality of protruding parts. Each of the plurality of anchoring members includes a surface facing each of the plurality of the star wheels and a concave part along the surface. The plurality of electromagnets corresponds to the plurality of anchoring members. The control unit is configured to control one or more of the plurality of electromagnets to be a first state by supplying a first electricity and control each of the plurality of electromagnets to be a second state by supplying a second electricity, wherein the second electricity is lower than the first electricity. Each of the plurality of anchoring members is configured to engage with one of the plurality of protruding parts in the second state. The one or more of the plurality of anchoring members is configured to rotate about a second axis extending parallel to the first axis in the first state.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Figure 1:
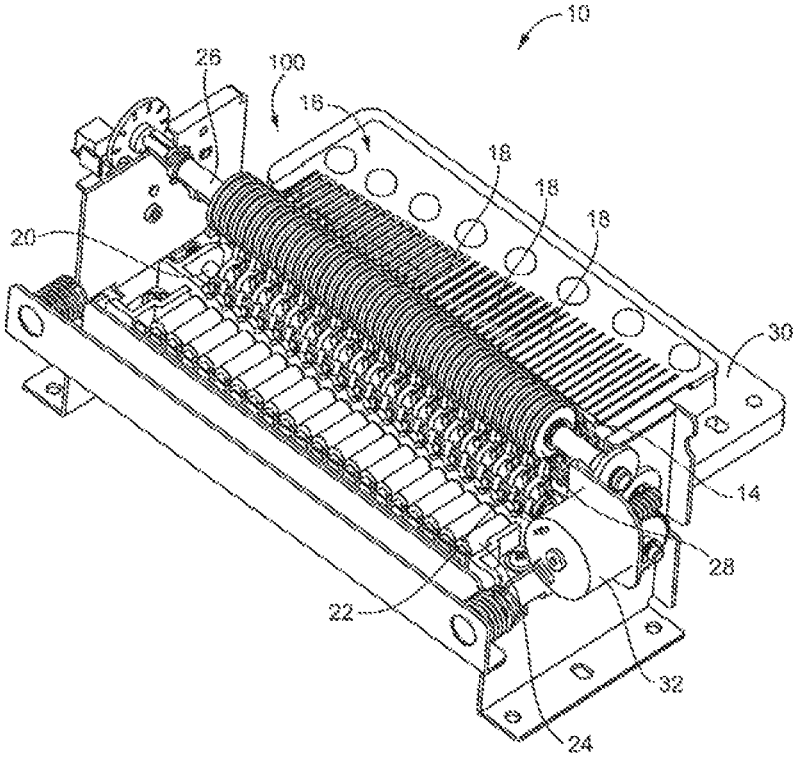
FIG. 1 is a schematic perspective view of a music box according to one or more aspects of the disclosure.

Next, a music box 10 according to a preferred embodiment of the present disclosure will be described while referring to the accompanying drawings. FIG. 1 shows the structure of a mechanical performance unit 100 provided in the music box 10 according to the preferred embodiment. FIG. 1 is a perspective view of the mechanical performance unit 100 from obliquely above the same. In the preferred embodiment, the top of the music box 10 will be considered the uppermost portion of the music box 10 in a general vertical direction when the music box 10 is resting on a flat surface (not shown).

As shown in FIG. 1, the mechanical performance unit 100 includes a first shaft 12 (see FIG. 2 and other drawings); a plurality (forty in this example) of star wheels 14 rotatably provided on the first shaft 12; a vibration plate 16 provided alongside the first shaft 12 and each having a plurality of vibration valves 18 juxtaposed along the first shaft 12 at positions in one-to-one correspondence with the star wheels 14; a pair of second shafts 20 extending along the first shaft 12, and preferably parallel to the first shaft 12; a plurality of anchoring members 22 pivotally movable about each of the second shafts 20 and provided at positions in one-to-one correspondence with the star wheels 14; a plurality of electromagnets 24 disposed in positions in one-to-one correspondence with the anchoring members 22; a third shaft 26 arranged parallel to the first shaft 12; a plurality of sun wheels 28 provided on the third shaft 26 at positions in one-to-one correspondence with the star wheels 14 so as to rotate together with and not relative to the third shaft 26; a bedplate 30 for rotatably supporting the first shaft 12 and the third shaft 26 about their center axes, non-rotatably supporting the second shafts 20, and serving as a mounting base for the vibration plate 16, the electromagnets 24; and a motor 32 adapted to produce a drive force for driving the first shaft 12 and the third shaft 26 to rotate about their axes in synchronization. The vibration valves 18 correspond to discrete predetermined musical tones and produce a sound at the corresponding tone when plucked by a protruding part 36 (described later) on the corresponding star wheel 14. The mechanical performance unit 100 shown in FIG. 1 is accommodated in an enclosure 34 of the music box 10 described below by assembling the bedplate 30 to the enclosure 34.

Figure 13:
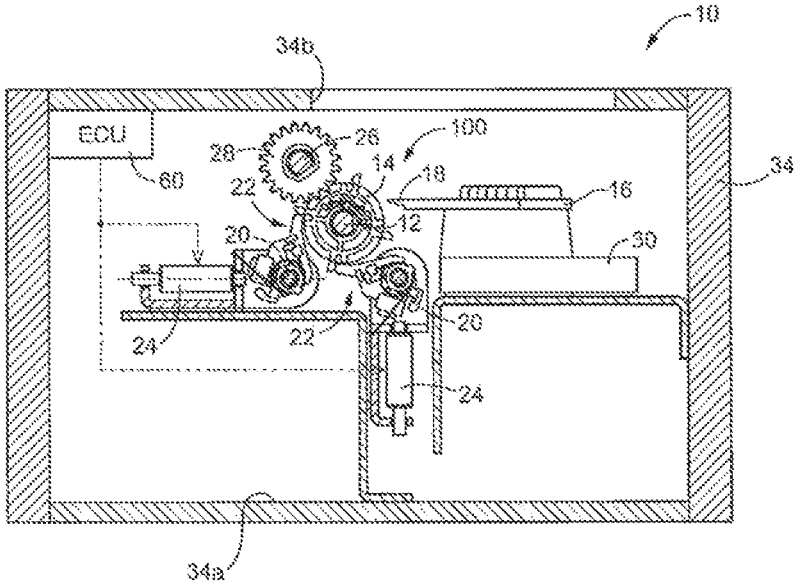
FIG. 13 is a cross-sectional view of the music box when the mechanical performance unit is accommodated in an enclosure according to one or more aspects of the disclosure.

FIG. 13 is an explanatory diagram showing the music box 10 of the preferred embodiment when the mechanical performance unit 100 of FIG. 1 is accommodated inside the enclosure 34. As shown in FIG. 13, the music box 10 is provided with the enclosure 34 for accommodating therein the components of the mechanical performance unit 100, including the first shaft 12, the star wheels 14, the vibration plate 16, the second shafts 20, the anchoring members 22, the electromagnets 24, the third shaft 26, and the sun wheels 28. That is, the mechanical performance unit 100 having the structure shown in FIG. 1 is accommodated inside the enclosure 34 by mounting the bedplate 30 on the enclosure 34. As shown in FIG. 13, the enclosure 34 defines an inner bottom surface 34*a*, and a viewing window 34*b*.

As indicated by a chain line in FIG. 13, the center of the second shaft 20 and at least some of the electromagnets 24 are arranged in the same plane, which is parallel to the inner bottom surface 34*a* of the enclosure 34. That is, some of the electromagnets 24 extending in horizontal direction are arranged in the plane indicated by the chain line, and remaining of the electromagnets 24 extending vertically are shifted from the plane. This configuration provides the music box 10 capable of accommodating therein the plurality of anchoring member 22 and the plurality of electromagnet 24. Note that all of the electromagnets 24 may be arranged parallel to the inner bottom surface 34*a* of the enclosure 34.

The viewing window 34*b* is provided in the flat upper wall constituting the enclosure 34 to reveal the components inside the enclosure 34. The viewing window 34*b* is provided with a cover part (not shown) formed of glass or another transparent material. As shown in FIG. 13, the music box 10 also includes an electric control unit (ECU, example of a control unit) 60 adapted to control the excitation and non-excitation of each electromagnet 24.

Figure 2:
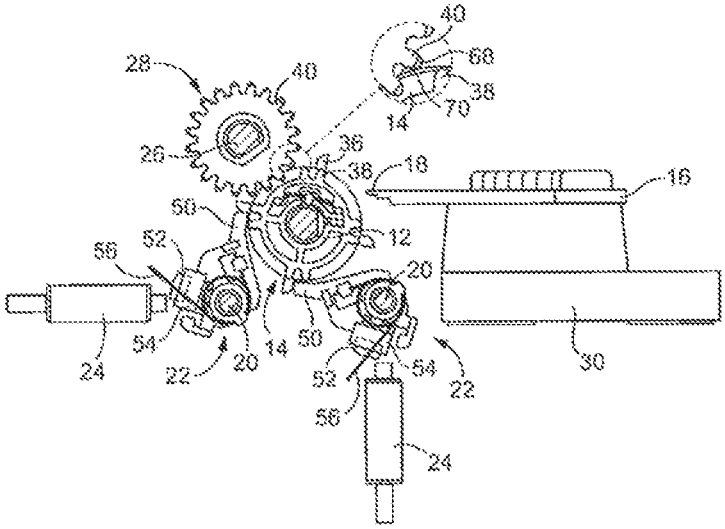
FIG. 2 is a schematic view showing a mechanical performance unit of the music box as viewed from an axial direction of a first shaft according to one or more aspects of the disclosure.
Figure 3:
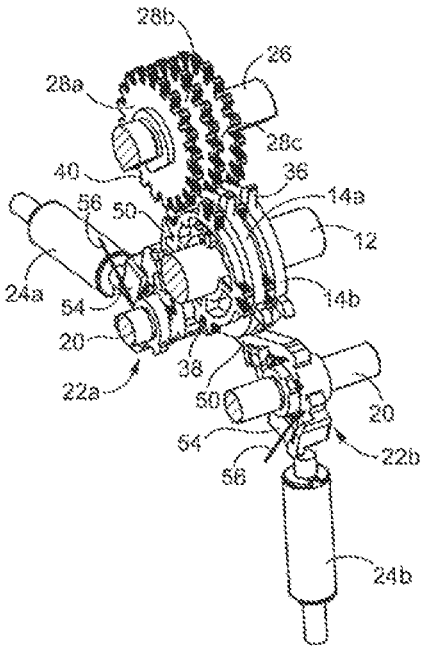
FIG. 3 is a perspective view of the mechanical performance unit shown in FIG. 2 according to one or more aspects of the disclosure.

FIG. 2 is a view of the mechanical performance unit 100 in the music box 10 along the axial direction of the first shaft 12 illustrating the structures of the star wheels 14, the anchoring members 22, the sun wheels 28, and the like. FIG. 3 is a perspective view from an angle obliquely above the mechanical performance unit 100 illustrating the structures of the star wheels 14, the anchoring members 22, the sun wheels 28, and the like. FIG. 3 shows two star wheels 14*a* and 14*b* of the plurality of star wheels 14 and two electromagnets 24*a* and 24*b* for the corresponding engaging members 22*a* and 22*b*.

In all drawings other than FIG. 3, where it is not necessary to distinguish among individual star wheels 14*a* and 14*b*, each star wheel is simply referred to using the reference numeral 14. Similarly, engaging members are simply referred to using the reference numeral 22 when it is not necessary to distinguish between individual engaging members 22*a* and 22*b*, and sun wheels are simply referred to using the reference numeral 28 when it is not necessary to distinguish among individual sun wheels 28*a*, 28*b*, and 28*c*.

The example of FIG. 3 shows the sun wheels 28*a* and 28*b* engageable with the star wheels 14*a* and 14*b*, as well as the sun wheel 28*c* neighboring the sun wheel 28*b*. Here, a neighboring sun wheel 28 is defined as a sun wheel 28 positioned next to another sun wheel 28 along the third shaft 26. The vibration plate 16 and the bedplate 30 have been omitted from FIG. 3 while portions of the first shaft 12, the second shaft 20, and the third shaft 26 are also omitted (cut).

As shown in FIGS. 2 and 3, each star wheel 14 is provided with a plurality of protruding parts 36 that protrude radially outward from the peripheral edge thereof. Preferably, four of the protruding parts 36 are provided at equal intervals, i.e., at every 90 degrees, around the periphery of the star wheel 14 in the circumferential direction thereof. A plurality of gear teeth 38 are formed at a position radially inside of the protruding parts 36. Preferably two of the gear teeth 38 are provided at positions corresponding to each protruding part 36. The gear teeth 38 are arranged between the star wheel 14 and the adjacent star wheel 14 in the first shaft 12 and, hence, are disposed at different positions from the protruding parts 36 with respect to the axial direction of the first shaft 12. In other words, the gear teeth 38 are positioned between pairs of neighboring protruding parts 36 with respect to the axial direction of the first shaft 12.

Each sun wheel 28 is provided with a plurality of gear teeth 40 around its peripheral edge. When the star wheel 14 is assembled on the first shaft 12 as shown in FIG. 2, the protruding parts 36 are disposed at positions for contacting at least a portion of the vibration valve 18 aligned with the rotational path of the protruding parts 36 upon the rotation of the star wheel 14 about the first shaft 12, i.e., the locus of the protruding part 36 is overlapped with the vibration valve 18. Further, the positions of the protruding parts 36 are disposed at positions such that the anchoring member 22 can engage the protruding parts 36 in an anchoring state described later. That is, when the anchoring member 22 contacts one of the protruding parts 36, the star wheel 14 is prevented from following the rotation of the first shaft 12. By contacting the protruding part 36 after the protruding part 36 has plucked the corresponding vibration valve 18 on the vibration plate 16, the anchoring member 22 functions as a stopper for preventing the star wheel 14 from continuing to follow the rotation of the first shaft 12. The rotational path of the gear teeth 38 about the axial center of the first shaft 12 is aligned with the corresponding gear teeth 40 of the sun wheel 28 so that the gear teeth 38 can engage with the gear teeth 40 provided on the sun wheel 28.

As illustrated in the enlarged view of FIG. 2 (the portion encircled by a dashed line), the gear teeth 40 of the sun wheel 28 is formed with chamfered edges 68 at the distal ends of the gear teeth 40 and preferably on both sides in the axial direction of the sun wheel 28. Chamfered edges 70 (see FIG. 4) are formed on the outer circumferential edges of the star wheels 14. The star wheel 68 defines an outer circumferential surface 72 formed with the chamfered edges 70. The star wheel 14 has two outer edges in the axial direction on the outer circumferential surface 72. As the sun wheel 28 and the star wheel 14 rotate, the edges of the gear teeth 40 in the axial direction of the sun wheel 28 overlap the edges of the circumferential surface 72 on the star wheel 14. Providing the chamfered edges 68 and 70 allows the gear teeth 40 to enter smoothly along the outer circumferential surface 72 without interference from the outer circumferential surface 72 or the like, thereby effectively reducing the occurrence of impact noise.

At least one of the chamfered edges 68 on the sun wheel 28 and the chamfered edges 70 on the star wheel 14 may be formed. In addition to the chamfered edges 70 formed in the circumferential surface 72 of the star wheel 14, chamfered edges may be formed in the edges of the protruding parts 36 (both axial edges) and the like. However, it is not mandatory to provide the chamfered edges 68 and 70 on the sun wheels 28 and the star wheels 14, respectively.

Figure 4:
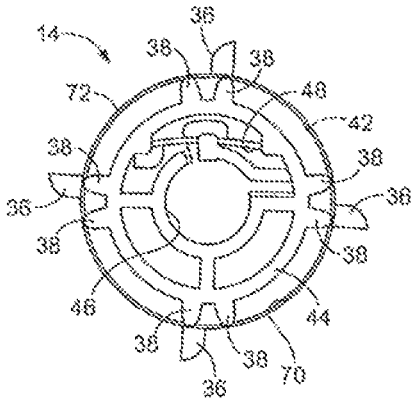
FIG. 4 is a front view of a star wheel provided in the music box as viewed from an axial direction thereof according to one or more aspects of the disclosure.

FIG. 4 is a front view of the star wheel 14 taken along the axial direction thereof to illustrate the structure of the star wheel 14 in greater detail. As shown in FIG. 4, the star wheel 14 preferably has a metal plate part 42 provided with the plurality of protruding parts 36 protruding radially outward therefrom. The metal plate part 42 is provided in a synthetic resin part 44 formed of an engineering plastic or other synthetic resin material through a process called insert molding. Insert molding is a method of integrally molding a metal member and a synthetic resin member by injecting the synthetic resin material around the metal member that has been pre-inserted within a metal die (the same method is used for other cases of insert molding described below). The synthetic resin part 44 preferably covers all portions of the metal plate part 42, excluding the protruding parts 36. The gear teeth 38 are resinous gear parts that are preferably configured as part of the synthetic resin part 44. As a result, the positional relationships of the protruding parts 36 and the gear teeth 38 can be maintained, even when a strong external force is applied to the protruding parts 36.

The synthetic resin part 44 has a center region formed with an assembly hole 46 penetrating the star wheel 14 in the axial direction thereof. The synthetic resin part 44 is assembled on the first shaft 12 by inserting the first shaft 12 through the assembly hole 46. The assembly hole 46 is formed at the center region of the synthetic resin part 44, thereby reducing the occurrence of chattering when the star wheel 14 contacts the corresponding sun wheel 28. The star wheel 14 is configured so that when assembled on the first shaft 12, a prescribed frictional force is exerted between the inner peripheral surface of the assembly hole 46 and the outer peripheral surface of the first shaft 12. Specifically, as shown in FIG. 4, the star wheel 14 is preferably provided with a friction spring 48 for producing a frictional force between the inner peripheral surface of the assembly hole 46 and the outer peripheral surface of the first shaft 12. The friction spring 48 is preferably piano wire that is deformed such that its restoring force pushes the inner peripheral surface of the assembly hole 46 against the outer peripheral surface of the first shaft 12. The frictional force produced by the friction spring 48 is stronger than the force acting to rotate the star wheel 14 and weaker than the force for disengaging the star wheel 14 from the anchoring member 22. With this configuration, the star wheel 14 is mounted on the first shaft 12 and can rotate about the same.

When the anchoring member 22 is in a non-anchoring state described later, the frictional force generated at the area of contact between the star wheel 14 and the first shaft 12 causes the star wheel 14 to rotate along with the first shaft 12. If the frictional force generated by the friction spring 48 is weaker than the force for rotating the star wheel 14, there is a danger that the star wheel 14 will spin out (i.e., slide over rather than rotate together with the first shaft 12) while the star wheel 14 is disengaged from the anchoring member 22. Conversely, if the frictional force is stronger than the force required to extract the star wheel 14 from the anchoring member 22 while the anchoring member 22 is in the anchored state, there is a danger that the star wheel 14 will force a plate member 50 (described later) of the anchoring member 22 to move leftward in FIG. 5 and inadvertently disengage from the anchoring member 22.

Figure 5:
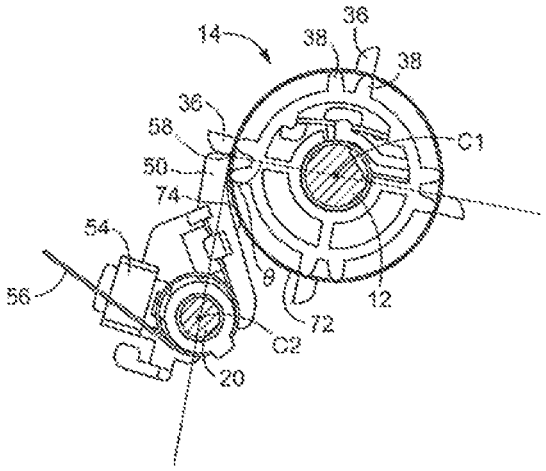
FIG. 5 is a schematic view illustrating a positional relationship between the star wheel and an anchoring member when the anchoring member is in an anchoring state according to one or more aspects of the disclosure.

As shown in FIGS. 2 and 5, the anchoring member 22 includes a plate member 50, a magnetic member 52, a synthetic resin member 54, a torsion coil spring 56, and a concave part 74. The plate member 50 is adapted to contact the protruding part 36 on the corresponding star wheel 14 by rotating the anchoring member 22 toward the star wheel 14 about the second shaft 20. The magnetic member 52 reacts to the magnetic force of the electromagnet 24 so as to rotate the anchoring member 22 in a direction for separating the anchoring member 22 from the star wheel 14. The magnetic member 52 is formed of metal whose primary component is an iron group element, such as iron, cobalt, or nickel. The magnetic member 52 is preferably an iron sheet that is not necessarily magnetized, but may be a permanent magnet (which is magnetized). The magnetic member 52 is formed in the synthetic resin member 54 through insert molding. In other words, the magnetic member 52 is embedded in the synthetic resin member 54. The synthetic resin member 54 is formed of an engineering plastic or the like provided integrally with the plate member 50. This construction can reduce chattering in the magnetic member 52 caused by the attraction of the electromagnet 24. The torsion coil spring 56 (example of an urging member) urges the anchoring member 22 to rotate toward the star wheel 14. In this way, rotation of the star wheels 14 can be controlled by rotating the corresponding torsion coil spring 56 using the magnetic force of the electromagnet 24. Further, the magnetic force generated in the electromagnet 24 is used for rotating the star wheel 14 to control the rotation thereof.

The electromagnet 24 is preferably configured of a cylindrical coil disposed around an iron core or other magnetic material. When electricity is supplied to the coil, the electromagnet 24 enters an excitation state (example of a first state) in which a magnetic force (magnetic field) is produced. When electricity is not flowing through the coil, the electromagnet 24 remains in a non-excitation state (example of a second state). In other words, the electromagnet 24 is a common electromagnet known in the art.

Figure 14:
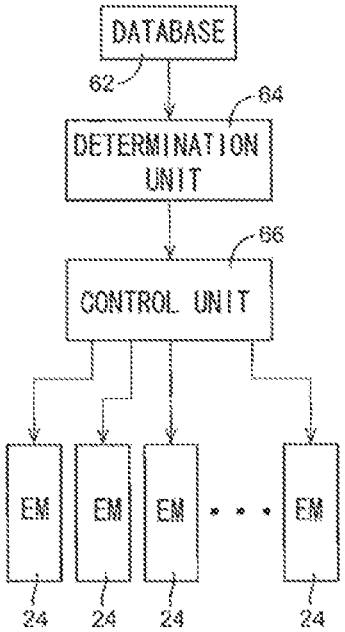
FIG. 14 is a block diagram of control functions of an electric control unit in the music box according to one or more aspects of the disclosure.

Next, the engaging and disengaging operations of the anchoring member 22 will be described with reference to FIG. 14. FIG. 14 is a block diagram showing the primary control functions possessed by the ECU 60. As shown in FIG. 14, the ECU 60 includes a musical score database 62, a release timing determination unit 64, and an electromagnet excitation control unit 66.

The musical score database 62 stores data for a plurality of musical scores corresponding to songs or melodies for the music box 10 to play. The musical score database 62 is stored on a storage medium, such as an SD card (Secure Digital card) well known in the art, and the ECU 60 is capable of reading the data stored on the storage medium. The musical scores may be stored in a data format such as MIDI (Musical Instrument Digital Interface) and may include a plurality of tracks (channels) for a predetermined plurality of instrument types, wherein the output timing, tone, and the like for sounds is specified for each instrument. As is described below in greater detail, the music box 10 according to the preferred embodiment can control a musical performance based on output timings, musical tones, and the like of each track corresponding to the melodic theme of the MIDI data, for example.

The release timing determination unit 64 determines a release timing at which each of the anchoring members 22 releases the engagement with the protruding part 36 of the corresponding star wheel 14. In other words, the release timing determination unit 64 determines the release timing for switching the excitation/non-excitation state of the electromagnet 24 corresponding to each of the anchoring members 22 (the release timing at which electricity to the electromagnets 24 is conducted and halted). For example, while the mechanical performance unit 100 is performing a melody corresponding to prescribed data for one of the musical scores stored in the musical score database 62, the release timing determination unit 64 performs the above determinations based on the output timing and musical tone for each sound specified in the musical score data. More specifically, the release timing determination unit 64 determines the release timing at which each anchoring member 22 releases the protruding part 36 of the corresponding star wheel 14 in order that the vibration valves 18 corresponding to the various musical tones are plucked at the output timings set in the musical score data.

When the rotations of the first shaft 12 and the third shaft 26 are set to constant speeds, a time lag indicating a period of time from when the anchoring member 22 releases the protruding part 36 of the corresponding star wheel 14 to when the protruding part 36 plucks the corresponding vibration valve 18 is determined in advance. The release timing determination unit 64 determines the release timing based on the musical score data for the melody being played. The output timing for the musical tone corresponding to each vibration valve 18 is specified in the musical score data. Thus, the release timing determination unit 64 determines the release timing such that the anchoring member 22 corresponding to the vibration valve 18 releases the protruding part 36 of the corresponding star wheel 14 prior to the output timing by a length of time equivalent to the time lag. The output timing for musical tone corresponding to each vibration valve 18 is specified in the musical score data. After switching the electromagnet 24 from the non-excitation state to the excitation state, the electromagnet excitation control unit 66 makes a determination to switch the electromagnet 24 back to a non-excitation state after a predetermined time has elapsed.

The electromagnet excitation control unit 66 switches the state of each electromagnet 24 between the excitation state and the non-excitation state based on the determination results of the release timing determination unit 64. In other words, the electromagnet excitation control unit 66 controls the timing at which electricity is conducted to, and not conducted to, each of the electromagnets 24 based on the determination results of the release timing determination unit 64. For example, when the release timing determination unit 64 has determined the release timing at which the anchoring member 22 releases the protruding part 36 of the corresponding star wheel 14, the electromagnet excitation control unit 66 switches the state of the corresponding electromagnet 24 from the non-excitation state to the excitation state based on this timing. Hence, the electromagnet excitation control unit 66 begins conducting electricity to the electromagnet 24 at this timing. After switching the electromagnet 24 from the non-excitation state to the excitation state, the electromagnet excitation control unit 66 preferably switches the electromagnet 24 back to the non-excitation state after a predetermined time has elapsed. Hence, the electromagnet excitation control unit 66 halts the conduction of electricity at this timing.

Figure 6:
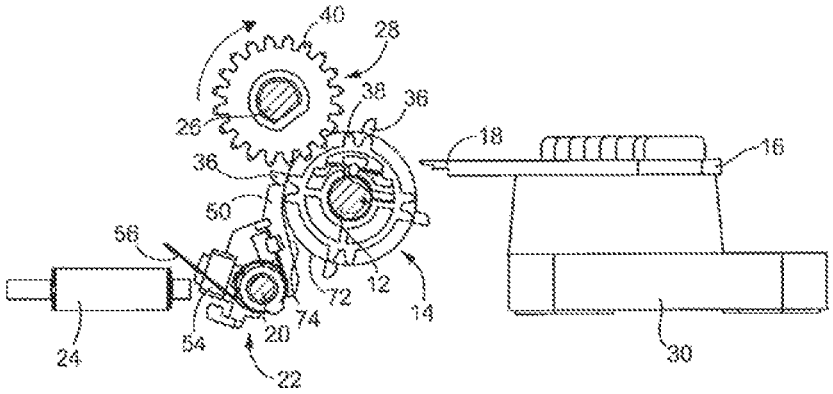
FIG. 6 is a schematic view of the mechanical performance unit when the anchoring member is in the anchoring state according to one or more aspects of the disclosure.

As shown in FIG. 2, the electromagnet 24 is provided for each of the anchoring members 22. The electromagnet 24 is positioned near the synthetic resin member 54 of the anchoring member 22 having the embedded magnetic member 52, but is separated from the magnetic member 52 so as not to contact the same. In other words, the anchoring member 22 is closest to the electromagnet 24 in a closest position shown in FIGS. 7 and 8, and then the anchoring member 22 does not contact the electromagnet 24 in the closest position. That is, a prescribed gap is formed between the magnetic member 52 and the electromagnet 24 whether the anchoring member 22 is in an anchoring state or a non-anchoring state described later. This gap should fall within a range in which the magnetic force of the electromagnet 24 can affect the magnetic member 52 when the electromagnet 24 is excited. For example, the gap should be designed such that the magnetic force of the excited electromagnet 24 will attract the magnetic member 52, even when the anchoring member 22 is the farthest from the electromagnet 24 in a remote position, as shown in FIG. 6. Moreover, the gap should be set such that the attracting force of the electromagnet 24 can rotate the anchoring member 22 in a direction away from the star wheel 14. As indicated by the chain line in FIG. 8, the axial center of the electromagnet 24 (central axis of the iron core) is configured to intersect the rotational center of the anchoring member 22 (i.e., the axial center of the second shaft 20), as will be described later. A gap formed between the anchoring member 22 and the electromagnet 24 when the anchoring member 22 is positioned in the remote position is larger than a gap formed between the anchoring member 22 and the electromagnet 24 when the anchoring member 22 is positioned in the closest position. In other words, the anchoring member 22 is constantly separated from the electromagnet 24. With this construction, each anchoring member 22 is rotated through a noncontact operation of applying the magnetic force of the electromagnet 24 in order to control the rotation of the corresponding star wheel 14, thereby suitably minimizing the generation of unwanted noise. Hence, the present disclosure can provide the music box capable of minimizing the generation of unwanted noise.

The torsion coil spring 56 preferably urges the anchoring member 22 and the plate member 50 toward the star wheel 14 when the electromagnet 24 is in the non-excitation state. The plate member 50 is an anchoring state (see FIG. 6 described later) for anchoring at the protruding parts 36 provided on the corresponding star wheel 14. However, when the electromagnet 24 is in the excitation state, the magnetic force of the electromagnet 24 causes the anchoring member 22 and the plate member 50 to rotate about the second shaft 20 in a direction away from the star wheel 14 against the urging force of the torsion coil spring 56. The anchoring member 22 comes to a halt at a position in which the force of attraction on the magnetic member 52 corresponding to the magnetic force of the electromagnet 24 is counterbalanced by the urging force of the torsion coil spring 56. In this position, the anchoring member 22 is in the non-anchoring state (see FIGS. 7 through 9 described later) in which the plate member 50 no longer anchors the protruding part 36.

As shown in FIG. 6 and other drawings, the concave part 74 is formed in the surface of the plate member 50 that faces the star wheel 14 and is configured as a concave depression adjacent to the circumferential surface 72 of the star wheel 14. The concave part 74 is a curved surface that curves in accordance with the circumferential surface 72 of the star wheel 14 and preferably has a smaller curvature than the circumferential surface 72. The concave part 74 preferably has a circular arc or elliptic arc shape that arcs toward the rotational center of the first shaft 12. The concave part 74 is configured of a first flat portion, a second flat portion cross the first flat portion, and a curved surface. The first flat portion extends from the distal end of the plate member 50, i.e., the end of the plate member 50 that firstly contacts the protruding part 36, to a midpoint of the plate member 50. The second flat portion extends from the base end of the plate member 50 near the second shaft 20, i.e., the side about which the plate member 50 rotates, to a midpoint of the plate member 50 that forms a prescribed angle with the first flat portion. The curved surface connects the first flat portion to the second flat portion. The concave part 74 is preferably shaped such that the protruding part 36 is in sliding contact with the concave part 74 after being disengaged from the anchoring member 22 as the star wheel 14 rotates, and the anchoring member 22 gradually approaches the circumferential surface 72 of the star wheel 14 as the star wheel 14 rotates further. The shape of the concave part 74 will be described later in greater detail with reference to FIGS. 6 through 12.

As shown in FIGS. 2 and 3, the electromagnets 24 and the anchoring members 22 corresponding to these electromagnets 24 belong to either a first group or a second group. The electromagnets 24 and the anchoring members 22 belonging to the first group are arranged at a 90-degree phase differential about the axial center of the first shaft 12 (at a position for forming an angle of 90 degrees) with the electromagnets 24 and the anchoring members 22 belonging to the second group. If the electromagnets 24 were numbered from 1 to n from one end of the second shafts 20 to the other, the electromagnets 24 with odd numbers preferably belong to the first group while those with even numbers preferably belong to the second group. Thus, the electromagnets 24, such as the electromagnets 24*a* and 24*b* in FIG. 3 corresponding to the pair of adjacent star wheels 14*a* and 14*b*, are preferably arranged apart from each other by a phase of 90 degrees about the axial center of the first shaft 12. This configuration minimizes the space required for arranging the mechanical performance unit 100 (and particularly the electromagnets 24) in the music box 10, thereby reducing the size of the music box 10.

FIG. 5 shows an example of the positional relationship between the anchoring member 22 and the corresponding star wheel 14 when the anchoring member 22 is in the anchoring state. When the anchoring member 22 is in this state, the angle θ formed by a straight line passing through a contact part 58 at which the protruding part 36 contacts the plate member 50 of the anchoring member 22 and a rotational center C1 of the star wheel 14, and a straight line passing through the contact part 58 and a rotational center C2 of the anchoring member 22 is preferably within a prescribed range with respect to a right angle (90 degrees) as a reference angle. This prescribed range is 90±10 degrees, for example. When the angle θ is smaller than this prescribed angular range, the anchoring member 22 can more easily disengage from the protruding part 36 and, hence, cannot as easily anchor the star wheel 14. When the angle θ is greater than the prescribed angular range, a relatively large force is necessary to disengage the anchoring member 22 from the protruding part 36 and, hence, the anchoring member 22 does not disengage easily. However, when the angle θ is within the prescribed angular range, the anchoring member 22 is restrained from disengaging when the electromagnet 24 is in the non-excitation state and can be suitably disengaged when the electromagnet 24 is shifted to the excitation state.

FIGS. 6 through 12 detail the operations of the mechanical performance unit 100 having the structure described above. When the music box 10 is playing a melody, the first shaft 12 and the third shaft 26 are constantly and synchronously driven by the motor 32 to rotate about their axial centers. As indicated by arrows in the drawings, the first shaft 12 and the third shaft 26 are driven to rotate in opposite directions. The first shaft 12 is preferably rotated such that the protruding parts 36 provided on the star wheel 14 move in a direction for plucking the corresponding vibration valves 18 of the corresponding vibration plate 16 upward. The third shaft 26 is rotated so that the star wheels 14 are driven to rotate in the direction indicated by the arrow when the gear teeth 38 of the star wheels 14 are engaged with the gear teeth 40 of the corresponding sun wheels 28. Since the sun wheels 28 are incapable of rotating relative to the third shaft 26, the sun wheels 28 are constantly rotated about their axial centers as the third shaft 26 rotates about its axial center while the music box 10 is playing a melody.

FIG. 6 illustrates the operations of the mechanical performance unit 100 when the anchoring member 22 is in the anchoring state. In the state shown in FIG. 6, electricity is not being supplied to the electromagnet 24 and thus the electromagnet 24 is in a non-excitation state. At this time, the torsion coil spring 56 urges the plate member 50 of the anchoring member 22 so that the anchoring member 22 is rotated toward the star wheel 14 and one of the protruding parts 36 on the corresponding star wheel 14 is anchored by the anchoring member 22. That is, one of the protruding parts 36 contacts the distal end of the plate member 50 on the downstream side with respect to the rotating direction of the first shaft 12 (the side in which the rotation progresses).

As described above, the star wheel 14 is configured to follow the rotation of the first shaft 12 through the frictional force generated at the point of contact with the first shaft 12. In the state shown in FIG. 6, the anchoring member 22 is in the anchoring state for preventing the star wheel 14 from following the rotation of the first shaft 12, despite the frictional force at the contact point therebetween. That is, the star wheel 14 provided on the first shaft 12 rotates relative to the first shaft 12, with the surfaces of contact between the assembly hole 46 of the star wheel 14 and the first shaft 12 sliding over each other with a light load, while the phase of the star wheel 14 (the positional relationship of the star wheel 14 relative to the vibration valve 18 and the like) remains fixed. In this state, the gear teeth 38 on the star wheel 14 are not engaged with the gear teeth 40 on the sun wheel 28 and, hence, the rotation of the sun wheel 28 does not affect the rotation of the star wheel 14.

Figure 7:
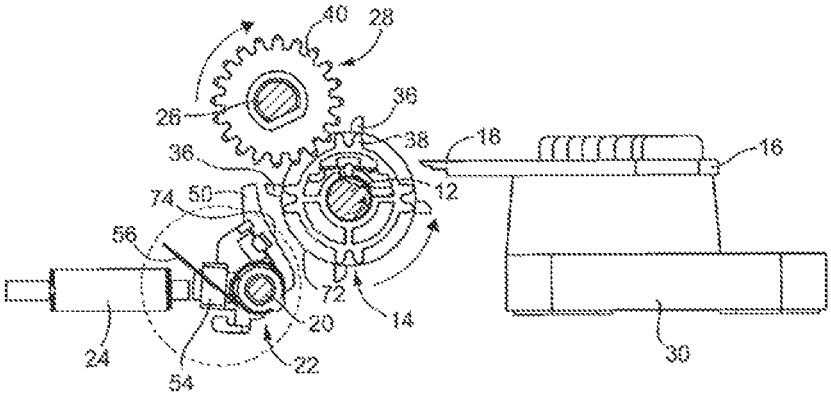
FIG. 7 is a schematic view of the mechanical performance unit when the anchoring member is shifted from the anchoring state to a non-anchoring state according to one or more aspects of the disclosure.

FIG. 7 illustrates the operations of the mechanical performance unit 100 when the anchoring member 22 is switched from the anchoring state to the non-anchoring state. When electricity is conducted to the electromagnet 24 while the mechanical performance unit 100 is in the state shown in FIG. 6, the electromagnet 24 is brought into the excitation state. The magnetic force produced by the electromagnet 24 causes the plate member 50 of the anchoring member 22 to rotate about the second shaft 20 against the urging of the torsion coil spring 56 in a direction away from the star wheel 14. Consequently, the plate member 50 that has anchored the protruding part 36 disengages therefrom, enabling the star wheel 14 to rotate together with the first shaft 12 due to the frictional force generated at the area of contact between the star wheel 14 and the first shaft 12. Immediately after electricity is conducted to the electromagnet 24 in order to disengage the protruding part 36 and plate member 50 from the state shown in FIG. 6, the plate member 50 preferably separates from the star wheel 14, as shown in FIG. 7. That is, the plate member 50 is rotated so that a prescribed gap is formed between the concave part 74 and the protruding part 36.

Figure 8:
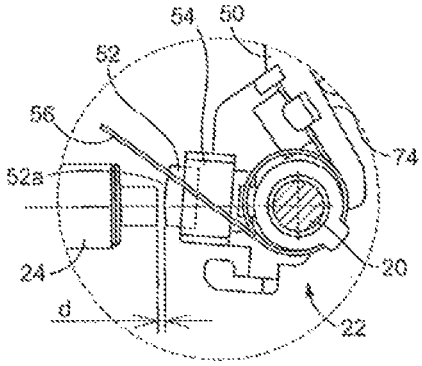
FIG. 8 is a partial enlarged view of an encircled region depicted in dotted line of FIG. 7 according to one or more aspects of the disclosure.

FIG. 8 shows an enlarged view of the area in FIG. 7 encircled by a dashed line. When the anchoring member 22 is in the non-anchoring state shown in FIG. 7, the magnetic member 52 is in the closest position to the axial center of the electromagnet 24 at the distal end thereof. In this state, the electromagnet 24 and the magnetic member 52 are not in contact with each other, and a gap d exists between the two, as shown in FIG. 8. A curved surface **52*a* is preferably formed on the side of the magnetic member 52 nearest the electromagnet 24. The curved surface 52*a* has a columnar shape centered on the second shaft 20. Hence, the gap d between the electromagnet 24 and the magnetic member 52 will not change when the anchoring member 22 is rotated about the second shaft 20**.

Figure 9:
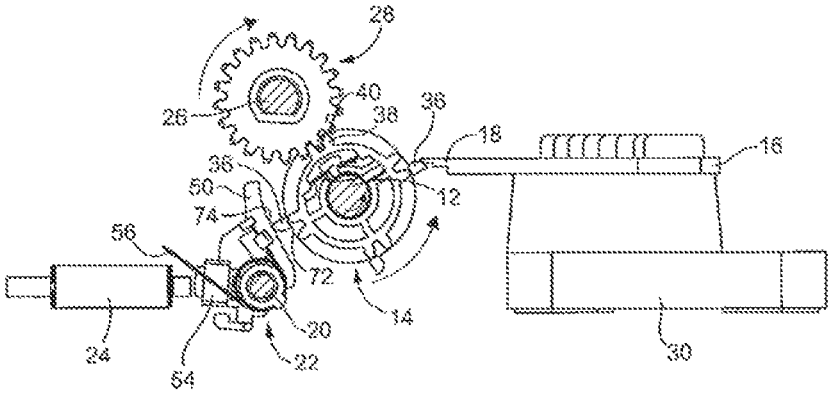
FIG. 9 is a schematic view of the mechanical performance unit when a protruding part of the star wheel plucks a vibration valve of a vibration plate according to one or more aspects of the disclosure.

FIG. 9 illustrates the operations of the mechanical performance unit 100 for playing a sound by plucking the vibration valve 18 of the vibration plate 16 with the corresponding protruding part 36 on the star wheel 14. In this operation, the electromagnet 24 is rendered in the non-anchoring state, causing the plate member 50 to disengage from the protruding part 36. Subsequently, the star wheel 14 begins to follow the rotation of the first shaft 12 due to the frictional force generated at the area of contact between the first shaft 12 and the star wheel 14. When the star wheel 14 is near a phase in which one of the protruding parts 36 contacts the corresponding vibration valve 18 on the vibration plate 16, the corresponding gear teeth 38 adjacent to the protruding part 36 in the rotating direction (at a phase difference of 90 degrees in the rotating direction) are engaged with the gear teeth 40 on the sun wheel 28. In this state, the rotation of the sun wheel 28 drives the star wheel 14 in the direction of the arrow indicated in FIG. 9, i.e., in a direction for moving the protruding part 36 upward to pluck the vibration valve 18 on the vibration plate 16. Through this operation, a sound at the tone corresponding to the vibration valve 18 is played.

As mentioned above, the concave part 74 is a depression formed in the surface of the plate member 50 facing the star wheel 14 and extending along the circumferential surface 72 of the star wheel 14. When the protruding part 36 is disengaged from the anchoring member 22, the protruding part 36 then slides along the concave part 74 as the star wheel 14 rotates about the first shaft 12. FIG. 9 shows the state of the protruding part 36 on the star wheel 14 contacting the concave part 74. The mechanical performance unit 100 transitions smoothly from the state shown in FIG. 7 to the state shown in FIG. 9, because the protruding part 36 separated by a gap from the concave part 74 in FIG. 7 gradually approaches the concave part 74 as the star wheel 14 rotates and eventually comes into sliding contact with the concave part 74. When the mechanical performance unit 100 is in the state of FIG. 9, the electromagnet 24 is switched from the excitation state to the non-excitation state. However, since the protruding part 36 is propping up the plate member 50 at this time, the anchoring member 22 does not rotate further toward the star wheel 14 despite the torsion coil spring 56 pressing the anchoring member 22 toward the star wheel 14.

The electromagnet 24 is preferably switched back to the non-excitation state from the excitation state after the protruding part 36 has contacted the concave part 74. In other words, after the protruding part 36 has been disengaged from the anchoring member 22 and the rotation of the star wheel 14 has brought the protruding part 36 into contact with the concave part 74, the electromagnet 24 is switched from the excitation state to the non-excitation state. The electromagnet excitation control unit 66 shown in FIG. 14 controls the excitation state of the electromagnet 24 in this process. That is, the electromagnet excitation control unit 66 waits a predetermined time after switching the electromagnet 24 to the excitation state before returning the electromagnet 24 to the non-excitation state such that the electromagnet 24 is switched back to the non-excitation state while the protruding part 36 is in contact with the concave part 74.

Figure 10:
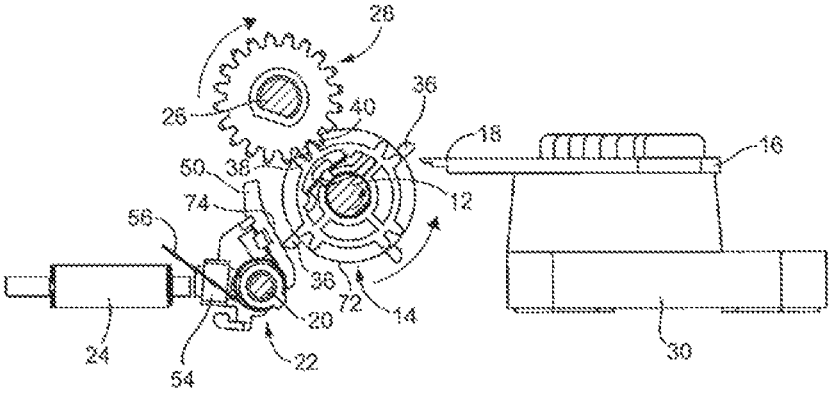
FIG. 10 is a schematic view of the mechanical performance unit when the protruding part is in sliding contact with a concave part of the anchoring member.
Figure 11:
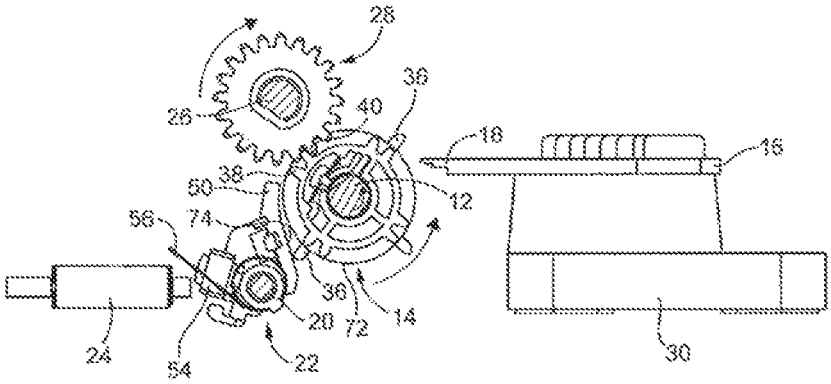
FIG. 11 is a schematic view of the mechanical performance unit when the protruding part is in sliding contact with the concave part according to one or more aspects of the disclosure.

FIGS. 10 and 11 illustrate the state of the protruding part 36 contacting the concave part 74 as the star wheel 14 rotates. As the star wheel 14 rotates from the state shown in FIG. 9, the anchoring member 22 gradually begins to approach the circumferential surface 72 of the star wheel 14. Accordingly, when the protruding part 36 is in sliding contact with the concave part 74 toward the second shaft 20 (the base end of the plate member 50) as the star wheel 14 rotates, the distal end of the plate member 50 of the anchoring member 22 gradually approaches the circumferential surface 72 of the star wheel 14 as illustrated in the transition between FIGS. 10 and 11.

Figure 12:
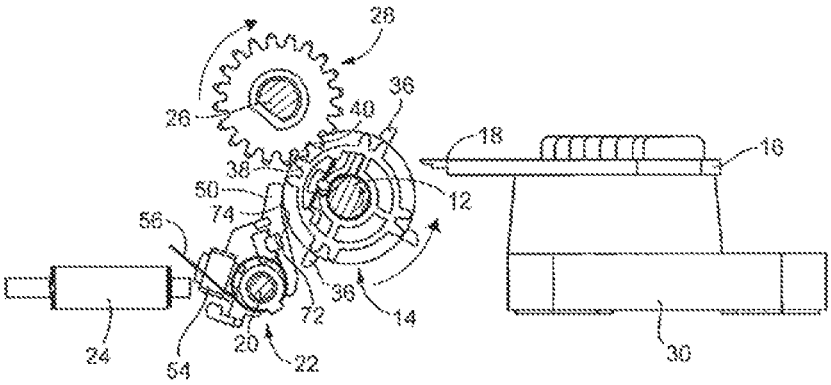
FIG. 12 is a schematic of the mechanical performance unit when a plate member is in contact with an outer peripheral surface of the star wheel according to one or more aspects of the disclosure.

FIG. 12 shows the state of the anchoring member 22 contacting the circumferential surface 72 of the star wheel 14 as the star wheel 14 rotates. As the star wheel 14 continues to rotate from the state shown in FIG. 11, the distal end of the plate member 50 of the anchoring member 22 contacts the circumferential surface 72 of the star wheel 14, as shown in FIG. 12. The protruding part 36 in sliding contact with the concave part 74 preferably separates from the concave part 74 after the distal end of the anchoring member 22 contacts the circumferential surface 72 of the star wheel 14. In other words, the star wheel 14 and the corresponding anchoring member 22 are relatively positioned such that, as the star wheel 14 rotates, the protruding part 36 will separate from the concave part 74 after the distal end of the anchoring member 22 contacts the circumferential surface 72 of the star wheel 14. As shown in FIG. 12, once the distal end of the plate member 50 of the anchoring member 22 has contacted the circumferential surface 72 of the star wheel 14, the anchoring member 22 cannot be rotated any further than the state shown in FIG. 12 despite the urging force of the torsion coil spring 56 pressing the anchoring member 22 toward the star wheel 14. The above configuration effectively suppresses the generation of noise caused by the anchoring member 22 impacting the circumferential surface 72.

The magnetic member of the anchoring member 22 may be configured of a permanent magnet. When the electromagnet 24 is in the excitation state, the magnetic force of the electromagnet 24 causes the permanent magnet to rotate the anchoring member 22 in the first rotating direction. The permanent magnet is preferably formed in the synthetic resin member 54, which is integrally provided with the plate member 50, through insert molding, and is preferably positioned to produce a repelling force (force of repulsion between like magnetic poles) with the electromagnet 24 when the electromagnet 24 is excited.

The magnetic force of the electromagnet 24, i.e., the force of repulsion produced between the electromagnet 24 and the permanent magnet, moves the plate member 50 of the anchoring member 22 against the urging force of the torsion coil spring 56. Accordingly, the anchoring member 22 rotates about the second shaft 20 in a direction away from the star wheel 14, thereby disengaging the plate member 50 from the protruding part 36 and placing the anchoring member 22 in the non-anchoring state.

While the disclosure has been described in detail with reference to specific embodiments thereof, it would be apparent to those skilled in the art that many modifications and variations may be made therein without departing from the spirit of the disclosure, the scope of which is defined by the attached claims.

In short, the present disclosure is not limited to the structure described above with reference to FIGS. 1 through 14. For example, the number of protruding parts 36 provided on each star wheel 14 is not limited to four and need not be arranged at 90-degree intervals around the periphery thereof. Further, the gear teeth 38 need not be provided at positions corresponding to the protruding parts 36 and may be positioned at different phases around the periphery of the star wheel 14.

Further, the electromagnets 24 and the anchoring members 22 belonging to the first group and the electromagnets 24 and the anchoring members 22 belonging to the second group need not be disposed at 90-degree intervals in a circumferential direction around the axial center of the first shaft 12. For example, all electromagnets 24 may be juxtaposed along the same plane. Conversely, if five or more of the protruding parts 36 were provided around the periphery of the star wheel 14, for example, pluralities of the electromagnets 24 and anchoring members 22 could be arranged at positions corresponding to three or more phases spaced at prescribed phase differences in a circumferential direction around the axial center of the first shaft 12, depending on the number of protruding parts 36 provided. Further, two or more of the anchoring members 22 may be provided for each star wheel 14 as the mechanism for anchoring the star wheel 14.

The ECU 60 may also be connected to the Internet or another communication link and may be configured to download musical score data via the communication link and store this data in the musical score database 62.

In addition, the shape of the star wheel 14, structure of the anchoring member 22 (shape of the plate member 50), phase positions of the various components, and the like may be modified as needed to suit the design of the music box. For example, the gear teeth 38 need not be provided in pairs, but may be provided in groups of one or three or more, provided that the sun wheel 28 can drive the star wheel 14 a sufficient distance and time interval for allowing the protruding part 36 to pluck the corresponding vibration valve 18 of the vibration plate 16.

What is claimed is:

1. A music box comprising:

a plurality of star wheels configured to rotate about a first axis, each of the plurality of star wheels comprising a plurality of protruding parts protruding outward in a radial direction of each of the plurality of star wheels;

a plurality of vibration valves corresponding to the plurality of star wheels, the plurality of vibration valves being arrayed along a first direction extending parallel to the first axis;

a plurality of anchoring members corresponding to the plurality of star wheels, each of the anchoring members being configured to engage corresponding one of the plurality of protruding parts, rotate about a second axis extending parallel to the first axis and be positioned remote from an electromagnet with a gap therebetween while being separate from the plurality of protruding parts of the corresponding star wheel;

a plurality of electromagnets corresponding to the plurality of anchoring members; and a control unit configured to a position of each of the plurality of anchoring members by changing a supply of electricity to a corresponding electromagnet of the plurality of electromagnets, wherein after the control unit supplies electricity to the corresponding electromagnet having a value of a first level, the corresponding electromagnet is excited and a corresponding anchoring member of the plurality of anchoring members disengages with one of the plurality of protruding parts of a corresponding star wheel of the plurality of star wheels, and wherein after the control unit supplies electricity to the corresponding electromagnet having a value of a second level, the corresponding electromagnet is not excited and the corresponding anchoring member engages one of the plurality of protruding parts of the corresponding star wheel.

2. The music box according to claim 1, wherein after the control unit supplies electricity to the corresponding electromagnet having a value of the first level the corresponding anchoring member rotates in a first rotational direction and wherein after the control unit supplies electricity to the corresponding electromagnet having a value of the second level, the corresponding anchoring member rotates in a second rotational direction opposed to the first rotational direction.

3. The music box according to claim 2, further comprising:

a plurality of urging members corresponding to the plurality of anchoring members, each of the plurality of urging members being configured to urge the corresponding anchoring member toward the corresponding star wheel in the second rotational direction, wherein after the control unit supplies electricity to the corresponding electromagnet having a value of the second level, a corresponding urging member of the plurality of urging members is configured to urge the corresponding anchoring member in the second rotational direction, wherein after the control unit supply electricity to the corresponding electromagnet having a value of the first level, the corresponding anchoring member is configured to rotate in the first rotational direction against an urging force of the corresponding urging member by an electromagnetic force generated in the corresponding electromagnet after the control unit supply electricity to the corresponding electromagnet having a value of the first level.

4. The music box according to claim 2, wherein each of the plurality of anchoring members includes:

a plate member configured to contact the protruding part of the corresponding star wheel after the control unit supplies electricity to the corresponding electromagnet having a value of the second level; and a magnetic member configured to react to a magnetic force generated in the corresponding electromagnet for rotating the anchoring member in the first rotational direction after the control unit supplies electricity to the corresponding electromagnet having a value of the first level.

5. The music box according to claim 4, wherein the plate member is formed using a synthetic resin, wherein the magnetic member is formed through an insert modeling into the plate member.

6. The music box according to claim 1, wherein each anchoring member is configured to contact the protruding part at a contact part, wherein when the anchoring member contacts the protruding part at the contact part, an angle between a first straight line passing through the contact part and a rotational center of the corresponding star wheel and a second straight line passing through the contact part and a rotational center of the anchoring member is within a predetermined range with respect to a right angle.

7. The music box according to claim 1, further comprising a casing comprising a bottom surface, wherein the plurality of anchoring members and the plurality of electromagnets are located in the casing, wherein at least a part of the plurality of electromagnets and a center of the second axis is located on a predetermined plane extending parallel to the bottom surface.

8. A music box comprising:

a plurality of star wheels configured to rotate about a first axis, each of the plurality of star wheels comprising a plurality of protruding parts protruding outward in a radial direction of each of the plurality of star wheels;

a plurality of vibration valves corresponding to the plurality of star wheels, the plurality of vibration valves being arrayed along a first direction extending parallel to the first axis;

a plurality of anchoring members corresponding to the plurality of star wheels, each of the anchoring members being configured to engage corresponding one of the plurality of protruding parts;

a plurality of electromagnets corresponding to the plurality of anchoring members; and a control unit configured to control one or more of the plurality of the electromagnets to be a first state by supplying an electricity and control each of the plurality of electromagnets to be a second state in which a supply of the electricity is stopped, wherein each of the plurality of anchoring members is configured to engage with one of the plurality of protruding parts in the second state, wherein the one or more of the plurality of anchoring members is configured to rotate about a second axis extending parallel to the first axis in the first state, and the one or more of the plurality of anchoring members is positioned remote from the electromagnet with a gap therebetween in the first state.

9. The music box according to claim 8, wherein the control unit is configured to control the one or more of the plurality of electromagnets to the first state in which the first electricity is supplied to the one or more of the plurality of electromagnets to rotate the anchoring member in a first rotational direction and each of the plurality of electromagnets to be the second state in which the supply of the electricity is stopped in each of the plurality of electromagnets to rotate the anchoring member in a second rotational direction opposed to the first rotational direction, wherein the each of the plurality of anchoring members engages the protruding part in the second state, wherein the one of the plurality of anchoring members rotates in the first rotational direction and disengages the protruding part in the first state.

10. The music box according to claim 9, further comprising:

a plurality of urging members corresponding to the plurality of anchoring members, each of the plurality of urging members being configured to urge each of the plurality of anchoring members toward the star wheel in the second rotational direction, wherein each of the plurality of urging members is configured to urge each of the plurality of anchoring members in the second state, wherein the one or more of the anchoring members are configured to rotate in the first rotational direction against an urging force of the urging member by an electromagnetic force generated in the one or more of electromagnets in the first state.

11. The music box according to claim 9, wherein each of the plurality of anchoring members includes:

a plate member configured to contact the protruding part of the star wheel in the second state; and a magnetic member configured to react to a magnetic force generated in the one or more of electromagnets for rotating the one or more of anchoring members in the first rotational direction in the first state.

12. The music box according to claim 11, wherein the plate member is formed using a synthetic resin, wherein the magnetic member is formed through an insert modeling into the plate member.

13. The music box according to claim 8, wherein the anchoring member is configured to contact the protruding part at a contact part, wherein, when in the second state, an angle between a first straight line passing through the contact part and a rotational center of the star wheel and a second straight line passing through the contact part and a rotational center of the anchoring member is within a predetermined range with respect to a right angle.

14. The music box according to claim 8, further comprising a casing comprising a bottom surface, wherein the plurality of anchoring members and the plurality of electromagnets are located in the casing, wherein at least a part of the plurality of electromagnets and a center of the second axis is located on a predetermined plane extending parallel to the bottom surface.

15. A music box comprising:

a plurality of star wheels configured to rotate about a first axis, each of the plurality of star wheels comprising a plurality of protruding parts protruding outward in a radial direction of each of the plurality of star wheels;

a plurality of vibration valves corresponding to the plurality of star wheels, the plurality of vibration valves being arrayed along a first direction extending parallel to the first axis;

a plurality of anchoring members corresponding to the plurality of star wheels, each of the anchoring members being configured to engage corresponding one of the plurality of protruding parts, each of the plurality of anchoring members comprising a surface facing each of the plurality of the star wheels and a concave part along the surface;

a plurality of electromagnets corresponding to the plurality of anchoring members; and a control unit configured to control one or more of the plurality of electromagnets to be a first state by supplying electricity and control each of the plurality of electromagnets to be a second state in which a supply of electricity to the plurality of electromagnets is stopped, wherein each of the plurality of anchoring members is configured to engage with one of the plurality of protruding parts in the second state, and wherein the one or more of the plurality of anchoring members is configured to rotate about a second axis extending parallel to the first axis in the first state.

16. The music box according to claim 15, wherein the concave part includes a first flat portion extending in a second direction, a second flat portion extending in a third direction intersecting with the second direction, and a curved surface connecting the first flat portion and the second flat portion.

17. The music box according to claim 15, wherein the concave part is shaped such that the protruding part is configured to be in sliding contact with the concave part.

18. The music box according to claim 15, further comprising:

a plurality of urging members corresponding to the plurality of anchoring members, each of the plurality of urging members being configured to urge each of the anchoring members toward the star wheel in a first rotational direction opposed to a second rotational direction, wherein each of the plurality of urging members is configured to urge each of the anchoring members in the first rotational direction in the second state, wherein the one or more of the plurality of anchoring members are configured to rotate in the second rotational direction against an urging force of the urging member by an electromagnetic force generated in the one or more of electromagnets in the first state.

19. The music box according to claim 15, wherein the control unit is configured to control the one or more of the plurality of electromagnets to be switched from the first state to the second state after a predetermined time has elapsed from when the control unit controls the one or more of electromagnets to be switched from the second state to the first state.

20. The music box according to claim 19, wherein the control unit controls the one or more of electromagnets to be switched from the first state to the second state when the protruding part is in sliding contact with the concave part.

* * * * *